United States Patent [19]

Austin et al.

[11] Patent Number: 4,850,431

[45] Date of Patent: Jul. 25, 1989

[54] METHOD OF FORMING A PLURALITY OF SPACED SUBSTANTIALLY PARALLEL FRACTURES FROM A DEVIATED WELL BORE

[75] Inventors: Carl E. Austin; Robert E. Rose, both of Duncan, Okla.

[73] Assignee: Halliburton Company, Duncan, Okla.

[21] Appl. No.: 190,806

[22] Filed: May 6, 1988

[51] Int. Cl.[4] ..... E21B 43/26

[52] U.S. Cl. ..... 166/308; 166/254

[58] Field of Search ..... 166/308, 307, 299, 271, 166/259, 281, 283, 297, 250, 252

[56] References Cited

U.S. PATENT DOCUMENTS 4,415,035 11/1983 Medlin et al. ..... 166/308

*Primary Examiner*—William P. Neuder

*Attorney, Agent, or Firm*—Robert A. Kent

[57] ABSTRACT

An improved method of forming a plurality of spaced substantially parallel fractures in a subterranean formation from a deviated well bore penetrating the formation is provided. The method comprises drilling a substantially vertical well bore into the formation and forming an initial fracture therein by applying hydraulic pressure to the formation. The in situ least principal stress direction in the formation is determined from the initial fracture and a deviated well bore is then drilled from the substantially vertical well bore into the formation at an angle and in a direction substantially parallel to the in situ least principal stress direction in the formation. Casing is placed in the deviated well bore, and a plurality of spaced fracture initiation points are created therein by forming a set of perforations of predetermined number and size through the casing and into the formation at the location of each of the fracture initiation points. Hydraulic pressure is applied under predetermined conditions to the sets of perforations at the fracture initiation points simultaneously to thereby extend a plurality of spaced substantially parallel fractures in the formation from the deviated well bore.

20 Claims, 1 Drawing Sheet

METHOD OF FORMING A PLURALITY OF SPACED SUBSTANTIALLY PARALLEL FRACTURES FROM A DEVIATED WELL BORE

BACKGROUND OF THE INVENTION

1. Field of the Invention

The present invention provides a method of forming a plurality of spaced, substantially parallel fractures from a deviated well bore, and more particularly, to such a method wherein fractures are extended in a subterranean formation from spaced fracture initiation points by applying hydraulic pressure to the formation via such initiation points.

2. Description of the Prior Art

In the production of hydrocarbons from subterranean rock formations penetrated by well bores, a commonly used technique for stimulating such production is to create and extend fractures in the formations. Most often, the fractures are created by applying hydraulic pressure to the subterranean formations from the well bores penetrating them. That is, a fracturing fluid is pumped through the well bore and into a formation to be fractured at a rate such that the resultant hydraulic pressure exerted on the formation causes one or more fractures to be created therein. The fractures are extended by continued pumping, and the fractures are either propped open by a propping agent, e.g., sand, deposited therein or the fracture faces are etched by a reactive fluid such as an acid whereby hydrocarbons contained in the formation readily flow through the fractures into the well bore.

The term "subterranean formation" is used herein to mean an entire subterranean rock formation bounded by formations formed of dissimilar rock materials or a hydrocarbon containing zone disposed within a larger rock formation.

Most fractures formed in formations by applying hydraulic pressure thereto lie in substantially vertical planes and extend outwardly from the well bore in a direction at right angles to the in situ least principal stress in the formation. When fractures are created from a substantially vertical well bore penetrating the formation, only two vertical fracture wings are often produced which extend from opposite sides of the well bore in a direction at right angles to the in situ least principal stress in the formation. This leaves a major portion of the formation without fractures, and less than a maximum hydrocarbon production increase is achieved.

In order to maximize the number of fractures created in a subterranean formation and the production of hydrocarbons therefrom, methods of creating a plurality of spaced, substantially parallel fractures from a single deviated well bore penetrating a formation have heretofore been developed and used. For example, U.S. Pat. No. 3,835,928 issued Sept. 17, 1974, discloses a method of forming a plurality of vertically disposed spaced fractures from a deviated well bore penetrating a formation. In accordance with that method, the deviated well bore is drilled in a direction transverse to a known preferred fracture orientation, spaced fracture initiation points are created in the deviated well bore, and spaced vertical fractures are produced in the formation by separately creating and extending a fracture from each fracture initiation point.

By the present invention an improved method of forming a plurality of spaced substantially parallel fractures from a single deviated well bore is provided.

SUMMARY OF THE INVENTION

A method of forming a plurality of spaced, substantially parallel fractures in a subterranean formation from a deviated well bore penetrating the formation is provided. In accordance with the method, a substantially vertical well bore is first drilled into the formation. An initial fracture is formed in the formation by applying hydraulic pressure thereto by way of the well bore, and the in situ least principal stress direction in the formation is determined from the fracture. A deviated well bore is next drilled from the substantially vertical well bore into the formation at the angle and in the direction of the in situ least principal stress direction. Casing is placed and preferably cemented in the deviated well bore, and a plurality of spaced fracture initiation points are created in the well bore by forming a set of perforations of a predetermined number and size through the casing into the formation at the location of each of the fracture initiation points. The predetermined number and size of the perforations at the fracture initiation points are such that a limited known flow rate of fracturing fluid will flow through each set of perforations upon the application of hydraulic pressure under predetermined conditions thereto. Hydraulic pressure under such predetermined conditions is applied to all of the sets of perforations at the fracture initiation points to thereby simultaneously extend a plurality of spaced substantially parallel fractures in the formation in directions substantially perpendicular to the deviated well bore direction. Propping agent is included in the fracturing fluid utilized to extend the plurality of fractures whereby the propping agent is deposited in the fractures and the fractures are propped open thereby. Alternatively, the fracture faces can be etched by contacting them with a reactive fluid to form flow channels therein.

In a preferred technique, after the sets of perforations at the fracture initiation points are created, each set of perforations at each fracture initiation point is isolated, and hydraulic pressure is applied thereto at the predetermined conditions to open the perforations and initiate fracturing. Subsequently, hydraulic pressure is simultaneously applied to all of the perforations at the fracture initiation points to extend the fractures and deposit the propping agent therein, or to extend the fractures and etch flow channels therein.

In addition to forming an initial fracture in the formation from the substantially vertical well bore penetrating the formation to determine the in situ least principal stress direction in the formation, other formation characteristics and properties determination techniques are preferably employed to facilitate the predetermination and design of optimum fracturing conditions. These include forming additional initial fractures in, above and below the formation, electrically logging the formation, determining fluid loss to the formation, etc. The term "predetermined conditions" as used in reference to the application of hydraulic pressure to the formation to cause fracturing means the particular type of fracturing fluid to be used and its characteristics such as viscosity, fluid loss, propping agent carrying capacity, etc; the flow rate and corresponding pressure of the fracturing fluid exerted on the formation at each fracture initiation point; the kind and quantity of propping agent utilized in the fracturing fluid; the particular spacing of the fracture initiation points in the deviated well bore; if the fracture faces are etched instead of being propped, the acid to be used; etc.

It is, therefore, a general object of the present invention to provide an improved method of forming a plurality of spaced, substantially parallel fractures from a deviated well bore penetrating the formation.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
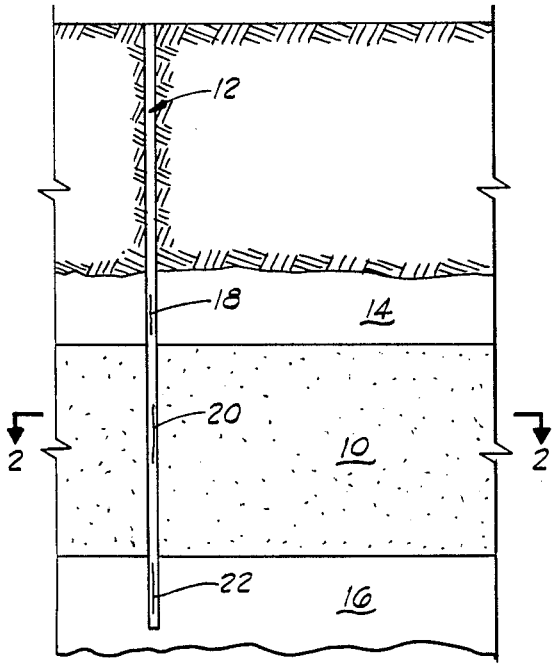
FIG. 1 is a cross-sectional view representing a substantially vertical well bore drilled through a subterranean formation to be fractured which is bounded by other formations.
Figure 2:
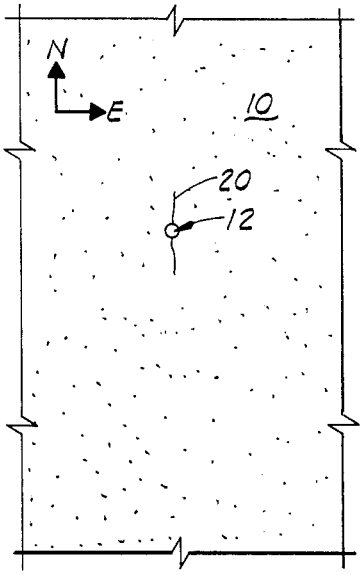
FIG. 2 is a cross-sectional view taken along line 2—2 of FIG. 1.

Referring now to the drawings, and particularly to FIGS. 1 and 2, the first step of the method of the present invention for forming a plurality of spaced, substantially parallel fractures in a hydrocarbon containing subterranean formation 10 is the drilling of a substantially vertical well bore 12 into the formation 10. As is the usual case, the subterranean rock formation 10 is bounded by an upper formation 14 and a lower formation 16 formed of dissimilar rock materials. In order to determine the direction of the in situ least principal stress in the formation 10 as well as the relative least principal stress levels in the formation 10 and in the adjacent formations 14 and 16, the well bore 12 is preferably drilled through the formation 10 and into the lower bounding formation 16.

The direction of the in situ least principal stress in the formation 10 is required because it is at right angles to that direction that fractures induced in the formation will extend. A knowledge of the relative levels of the in situ least principal stresses in the formation 10 and in the bounding formations 14 and 16 is advantageous in that it indicates whether fractures formed in the formation 10 will be confined thereto. That is, if the hydrocarbon containing formation 10 has the lowest in situ least principal stress level, then fractures can be created and extended in that formation without fear of also fracturing the formations 14 and/or 16 which may contain undesirable fluids such as salt water. If the converse situation exists, the fracturing procedure can be carried out in a manner which avoids extending fractures from the formation 10 into the formations 14 or 16.

In order to determine the in situ least principal stresses in the hydrocarbon bearing formation 10, and preferably, in the formations 14 and 16 above and below the formation 10, initial fractures 18, 20 and 22 are formed in the formations 14, 10 and 16, respectively, by applying hydraulic pressure thereto by way of the well bore 12. Upon forming each fracture, the in situ least principal stress direction can be determined from the direction of the fracture formed. That is, a fracture in a rock formation occurs in a plane which is at right angles to the direction of the in situ least principal stress and the fracture direction can be determined, e.g., by the use of a direction orientated fracture impression packer, by a direction orientated borehole televiewer, or by extracting a location orientated core. The in situ least principal stress level for each formation is determined from the hydraulic pressure utilized during the initial fracturing procedure.

The determinations of the induced fracture direction in the formation 10 and the relative in situ least principal stress levels of the formations 10, 14 and 16 are preferably made during the drilling of the well bore 12 utilizing the drill pipe and drilling fluid in accordance with the method described in U.S. Pat. No. 4,529,036 to Daneshy et al. issued July 16, 1985, which is incorporated herein and made a part hereof. In accordance with that method a fracture is created during drilling by exerting hydraulic pressure with drilling fluid by way of the drill pipe on the bottom of the well bore. The fracture formed extends from the lower end portion of the well bore, and a location orientated core containing a portion of the fracture is removed from the well bore to thereby determine the direction of the in situ least principal stress in the formation. The least principal stress level in the formation and other characteristics of the formation and its fracturing are also determined as described in the patent.

Thus, fractures 18, 20 and 22 are preferably formed in the formations 14, 10 and 16, respectively, as the well bore 12 is drilled, and the in situ least principal stress direction in the formation 10 and the least principal stress levels in all of the formations are determined. Subsequently, additional test procedures to determine the properties of the rock material making up the formation 10 can be carried out. Generally, the initial fracturing and other testing performed in the well bore 12 provide the in situ least principal stress direction as described, the stress level above, in and below the subterranean formation to be fractured as described, the hydraulic pressure required to fracture the formation, the fracture closure pressure and the fracture extension pressure. Using such information, the optimum conditions for fracturing the formation 10 can be predetermined. That is, the particular type of fracturing fluid to be used and the fracturing fluid characteristics required, the fracturing fluid pumping rate required, the depth, angle and direction of the deviated well bore to be drilled, the spacing of the fracture initiation points in the well bore, the size and number of perforations required at each initiation point, and other conditions can all be predetermined.

Figure 3:
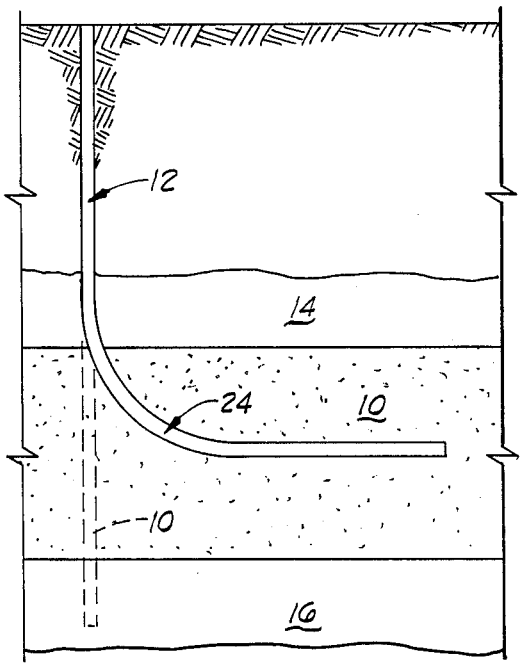
FIG. 3 is a cross-sectional view similar to FIG. 1, but showing a deviated well bore drilled into the subterranean formation to be fractured from the previously drilled substantially vertical well bore.

Once the well bore 12 has been drilled, the initial fracturing and other testing procedures have been carried out therein and the predetermined conditions described above have been determined, a lower portion of the substantially vertical well bore 12 is filled with cement or otherwise plugged back to a level above the formation 10. As illustrated in FIG. 3, a second deviated well bore 24 is then drilled from the upper portion of the substantially vertical well bore 12 into the formation 10 at an angle and in a direction corresponding to the in situ least principal stress direction in the formation 10.

Figure 4:
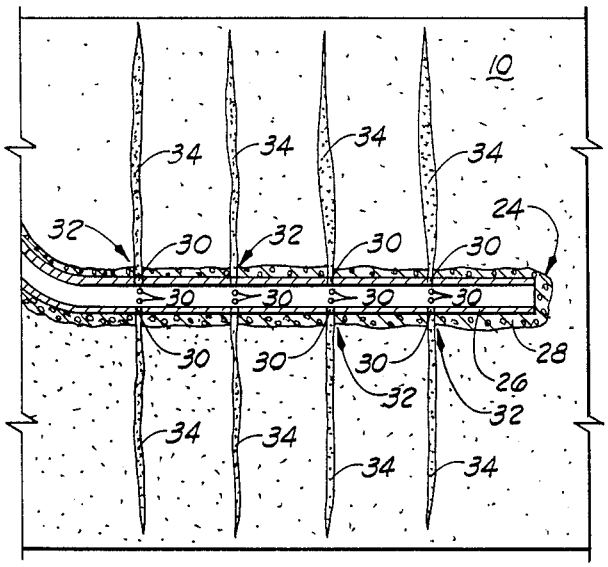
FIG. 4 is an enlarged cross-sectional view of a portion of the deviated well bore of FIG. 3 after having casing cemented therein and a plurality of substantially vertical fractures formed in the formation therefrom.

As shown in FIGS. 1 and 2, the plane of the initial fracture 20 formed in the formation 10 is substantially vertical and extends in a north-south direction. Therefore, the deviated well bore 24 is drilled at an angle and in a direction transverse to a vertical north-south plane extending through the formation 10. Preferably, the deviated well bore 24 is drilled at an angle and in a direction perpendicular to such vertical north-south plane as shown in FIGS. 3 and 4, i.e., in a horizontal east-west direction. Upon completing the drilling of the deviated well bore 24, casing is placed and cemented therein in the usual manner as shown in FIG. 4.

Referring now specifically to FIG. 4, a portion of the deviated well bore 24 after casing 26 has been set therein is illustrated. That is, a metal casing 26 is disposed in the well bore 24 and is bonded to the formation 10 by a cement sheath 28.

The number and spacing of the parallel fractures to be formed in the subterranean formation 10 as well as the particular positioning of the deviated well bore therein between the top and bottom thereof are predetermined using the information derived from the initial fracturing and testing procedures described above. Generally, the spacing, length of fractures and other aspects of the fractures to be formed in the formation 10 are designed so that the maximum production of hydrocarbons from the formation 10 will be obtained.

In order to produce fractures extending from the well bore 24 after the casing 26 has been set therein, a set of perforations 30 of a predetermined number and size are created at fracture initiation points 32 spaced along the casing 26. The perforations 30 extend through the casing 26, through the cement sheath 28 and into the formation 10. The particular number and size of the perforations 30 at each fracture initiation point 32 are predetermined whereby a limited but known flow rate of fracturing fluid will flow through the perforations at each fracture initiation point upon the application of hydraulic pressure under predetermined conditions thereto. That is, when a fracturing fluid is pumped at a predetermined flow rate, pressure and other conditions into the well bore 24, the set of perforations 30 at each fracture initiation point 32 restricts the flow rate of fracturing fluid into the formation 10 therethrough, which causes fracturing fluid to flow through each of the sets of perforations 30 at the initiation points 32 at a known flow rate which produces and extends a fracture therefrom.

Once a set of the perforations 30 has been created at each fracture initiation point 32, hydraulic pressure is applied under the predetermined conditions to the formation 10 by way of all of the sets of perforations 30 whereby fractures 34 are simultaneously extended from the initiation points 32 into the formation 10. The application of hydraulic pressure to the formation 10 by way of the sets of perforations 30 involves the pumping of a fracturing fluid into the well bore 24 at a rate and pressure and for a time sufficient to cause fracturing fluid to flow through the sets of perforations 30, extend the fractures 34 a predetermined distance from the well bore 24 within the formation 10 and deposit propping agent in the fractures or etch flow channels in the fracture faces. The pumping is then terminated, the well bore 10 is shut in for a time, the fracturing fluid is reverse flowed back to the surface and the well is placed on production.

In a most preferred technique, prior to applying the hydraulic pressure by way of all of the perforations 30, each set of perforations 30 at the fracture initiation points 32 is isolated by means of packer devices, and hydraulic pressure is applied to the formation 10 by way of each set of perforations by pumping a fracturing fluid through the perforations at the predetermined conditions discussed above. This preliminary application of hydraulic pressure to the formation by way of the individual sets of perforations 30 functions to insure that the perforations are open and to initially fracture the formation 10 at each of the fracture initiation points 32. Also, the information relating to the fractures thus formed can be used to check such variables as fluid loss and to thereby insure that the final application of hydraulic pressure to the formation by way of all of the sets of perforations is at proper design conditions, etc. The application of hydraulic pressure to the formation 10 by way of all of the sets of perforations 30 is then carried out to simultaneously extend the fractures 34, etc. As will be understood, the final application of hydraulic pressure to the formation by way of all of the sets of perforations simultaneously may not in some instances be possible due to limited pumping capacity. In such cases, the hydraulic pressure can be applied to groups of perforation sets successively.

In order to further illustrate the present invention and facilitate a clear understanding thereof, the following example is given.

EXAMPLE

The method of the present invention whereby a plurality of spaced substantially parallel fractures are formed in a subterranean formation is carried out in an active field. The treated formation is the Ratcliffe formation, the top of which is at a depth of 8772 feet below ground level.

A substantially vertical well bore is drilled through the Ratcliffe formation to be fractured and into the adjacent formation therebelow. Initial fractures are formed in the formation as well as in the bounding formations above and below it, and the fracture direction in the Ratcliffe formation is determined to lie in a plane which is substantially vertical and which extends in a northwest-southeast direction. The Ratcliffe formation is determined to have a in situ least principal stress level which is less than the least principal stress levels in the adjacent formations. In conjunction with the initial fracturing carried out from the substantially vertical well bore, a long space open hole sonic log is run to determine rock properties. The following fracture treatment design information is predetermined from the test data developed by the initial fracturing and sonic logging procedures:

| | |
|---|---|
| Type of fracturing fluid to be used: | organotitanate crosslinked hydroxypropylguar |
| Fracturing fluid apparent viscosity: | 32 cp before crosslinking and 139 cp after crosslinking measured at a 0.02 inch fracture width |
| Bottom hole hydraulic pressure required to fracture the formation: | 6000 psi |
| Bottom hole fracture closure pressure: | 6000 psi |
| Bottom hole fracture extension pressure: | 6000 psi |
| Fracturing fluid flow rate required per fracture: | 13 bpm |

-continued

| | |
|---|---|
| Number of fractures to be created: | 9 |
| Fracture and fracture initiation point spacing: | 250 feet |
| Number and size of perforations at each initiation point: | 4 having a 0.55 inch diameter |
| Angle and depth of deviated well bore: | 90° from vertical at a depth of 8809 feet |
| Direction of deviated well bore: | northeast or southwest |

The lower portion of the substantially vertical well bore is plugged back to a depth of 7850 feet, and a deviated well bore is drilled extending therefrom into the Ratcliffe formation to a depth of 8809 feet below the top and then horizontally in a northeast-southwest direction for a distance of 2000 feet. Nine fracture initiation points at a 250 feet spacing are created in the deviated well bore by forming 4 0.55-inch diameter perforations through the casing and into the formation at each fracture initation point. Each set of perforations thus formed will allow a 13 bpm flow rate of crosslinked gelled water having a viscosity of 139 cp and containing an average of 4.8 pounds of sand per gallon of fracturing fluid to flow into the formation when a total flow rate of such fracturing fluid of 117 bbl/min. is pumped into the well bore at a bottom hole treating pressure of 6000 psig.

Prior to pumping the fracturing fluid containing propping agent into the well bore, each of the sets of perforations at the fracture initiation points is isolated and the fracturing fluid without propping agent is pumped thereinto at a flow rate of 13 bbl/min. and a bottom hole treating pressure of 6000 psig. for a time period sufficient to open the perforations and initially fracture the adjacent formation. Subsequently, the fracturing fluid containing propping agent, i.e., sand, is pumped into the well bore at the above described rate and pressure to simultaneously extend all of the fractures in the formation and deposit propping agent therein. After recovery of the fracturing fluid, the fractured formation successfully produces oil at a high rate as compared to conventionally fractured wells in the same formation.

Thus, the present invention is well adapted to carry out the objects and attain the ends and advantages mentioned as well as those inherent therein. While numerous changes can be made in the sequence of steps and testing techniques employed, such changes are encompassed within the spirit of this invention as defined by the appended claims.

What is claimed is:

1. A method of forming a plurality of spaced substantially parallel fractures in a subterranean formation from a deviated well bore penetrating the formation comprising the steps of:

(a) drilling a substantially vertical well bore into said formation;

(b) forming a fracture in said formation by applying hydraulic pressure to said formation by way of said well bore;

(c) determining the in situ least principal stress direction in said formation from the fracture formed in step (b);

(d) drilling a deviated well bore from said substantially vertical well bore into said formation at an angle and in a direction substantially parallel to the in situ least principal stress direction in said formation as determined in step (c);

(e) placing casing in said deviated well bore;

(f) creating a plurality of spaced fracture initiation points in said well bore by forming a set of perforations of a predetermined number and size through said casing into said formation at the location of each of said fracture initiation points whereby a limited known flow rate of fracturing fluid will flow through each set of perforations at said initiation points upon the application of hydraulic pressure under predetermined conditions thereto; and (g) simultaneously applying hydraulic pressure under said predetermined conditions to all of said sets of perforations at said fracture initiation points to thereby simultaneously form a plurality of spaced substantially parallel fractures in said formation extending in directions transverse to said in situ least principal stress direction from said well bore.

2. The method of claim 1 defined further to include the steps of isolating each set of perforations at each fracture initiation point and applying hydraulic pressure thereto to open said perforations and initiate fracturing prior to carrying out step (g).

3. The method of claim 2 wherein said deviated well bore is drilled in a direction corresponding to the in situ least principal stress direction in said formation.

4. The method of claim 3 wherein said subterranean formation contains hydrocarbons and said fracture initiation points are spaced to obtain maximum hydrocarbon recovery therefrom.

5. The method of claim 1 wherein the application of hydraulic pressure to said formation in accordance with step (b) comprises pumping a fracturing fluid into said formation at a rate and pressure sufficient to fracture said formation.

6. The method of claim 5 wherein said fracturing fluid is drilling fluid.

7. The method of claim 5 wherein said in situ least principal stress direction is determined in accordance with step (c) by removing a location orientated core containing a portion of said fracture from said well bore.

8. The method of claim 1 wherein the application of hydraulic pressure to said formation in accordance with step (g) comprises pumping a fracturing fluid containing suspended propping agent through said perforations and into said formation at a rate and pressure and for a time sufficient to fracture said formation, extend such fractures therein and deposit said propping agent in said fractures.

9. A method of producing a plurality of spaced substantially parallel fractures extending from a deviated well bore in a subterranean formation comprising the steps of:

(a) drilling a substantially vertical well bore into said formation;

(b) forming an initial fracture in said formation from said well bore by applying hydraulic pressure to said formation by way of said well bore;

(c) determining the in situ least principal stress direction in said formation from the fracture formed in step (b);

(d) drilling a deviated well bore from said substantially vertical well bore into said formation at an angle and in a direction substantially parallel to said in situ least principal stress direction in said formation as determined in step (c);

(e) placing casing in said deviated well bore;

(f) producing a plurality of spaced fracture initiation points in said deviated well bore by forming a set of perforations of a predetermined number and size through said casing into said formation at the location of each of said fracture initiation points whereby a limited known flow rate of fracturing fluid will flow through each set of perforations at said initiation points upon the application of hydraulic pressure under predetermined conditions thereto;

(g) isolating said perforations at each of said fracture initiation points and applying hydraulic pressure under said predetermined conditions to said perforations to open said perforations and initiate fractures in said formation; and (h) simultaneously applying hydraulic pressure under said predetermined conditions to said perforations at all of said initiation points to thereby form a plurality of spaced substantially parallel fractures in said formation extending in directions at right angles to said in situ least principal stress direction from said well bore.

10. The method of claim 9 wherein said deviated well bore is drilled in a direction corresponding to the least in situ principal stress direction in said formation.

11. The method of claim 9 wherein the application of hydraulic pressure to said formation in accordance with step (b) comprises pumping a fracturing fluid into said formation at a rate and pressure and for a period of time sufficient to fracture said formation.

12. The method of claim 11 wherein said fracturing fluid is drilling fluid.

13. The method of claim 12 wherein said in situ least principal stress direction is determined in accordance with step (c) by removing a location orientated core containing a portion of said fracture from said well bore.

14. The method of claim 9 wherein the application of hydraulic pressure to said formation in accordance with step (g) comprises pumping a fracturing fluid into said formation at a rate and pressure and for a period of time sufficient to fracture said formation.

15. The method of claim 9 wherein the application of hydraulic pressure to said formation in accordance with step (h) comprises pumping a fracturing fluid containing suspended propping agent through said perforations and into said formation at a rate and pressure and for a time sufficient to fracture said formation, extend such fractures therein and deposit said propping agent in said fractures.

16. The method of claim 9 wherein the application of hydraulic pressure to said formation in accordance with step (h) comprises pumping an acid solution through said perforations and into said formation at a rate and pressure and for a time sufficient to fracture said formation, extend such fractures therein and etch flow channels in the fracture faces.

17. A method of producing a plurality of spaced substantially parallel fractures extending from a deviated well bore in a subterranean formation comprising the steps of:

(a) drilling a substantially vertical well bore through said formation;

(b) producing one or more initial fractures in, above and below said formation from said well bore by applying hydraulic pressure to strata adjacent said well bore at selected locations;

(c) determining the in situ least principal stress direction in said formation, whether fractures will be contained within said formation and other information relating to fracturing said formation from the production of said initial fractures in accordance with step (b);

(d) electrically logging said formation by way of said well bore to determine physical properties of the rock making up said formation and other information relating to fracturing said formation;

(e) utilizing the information from steps (c) and (d) to predetermine the hydraulic pressure conditions required to fracture said formation and extend fractures therein;

(f) drilling a deviated well bore from said substantially vertical well bore into said formation at an angle and in a direction substantially parallel to said in situ least principal stress direction in said formation as determined in step (c);

(g) placing casing in said deviated well bore;

(h) producing a plurality of spaced fracture initiation points in said deviated well bore by forming a set of perforations of a predetermined number and size through said casing into said formation at the location of each of said fracture initiation points whereby a limited predetermined flow rate of fracturing fluid will flow through each set of perforations at said initiation points upon the application of hydraulic pressure thereto under the predetermined conditions determined in step (e);

(i) isolating said perforations at each of said initiation points and applying hydraulic pressure under said predetermined conditions to said perforations to open said perforations and initiate fracturing in said formation; and (j) simultaneously applying hydraulic pressure under said predetermined conditions to said perforations at all of said initiation points to thereby simultaneously extend a plurality of spaced substantially parallel fractures in said formation in directions substantially perpendicular to said in situ least principal stress direction.

18. The method of claim 17 wherein said deviated well bore is drilled in a direction corresponding to the in situ least principal stress direction in said formation.

19. The method of claim 17 wherein the application of hydraulic pressure to said formation in accordance with step (j) comprises pumping a fracturing fluid containing suspended propping agent through said perforations and into said formation at a rate and pressure and for a period of time sufficient to extend such fractures therein and deposit said propping agent in said fractures.

20. The method of claim 17 wherein the application of hydraulic pressure to said formation in accordance with step (j) comprises pumping an acid solution through said perforations and into said formation at a rate and pressure and for a period of time sufficient to extend fractures therein and etch flow channels in the fracture faces.

* * * * *